US012357864B2

(12) United States Patent
Oh

(10) Patent No.: US 12,357,864 B2
(45) Date of Patent: Jul. 15, 2025

(54) JUMPING EXERCISE EQUIPMENT

(71) Applicant: Ju Hwan Oh, Jeonju-si (KR)

(72) Inventor: Ju Hwan Oh, Jeonju-si (KR)

( * ) Notice: Subject to any disclaimer, the term of this patent is extended or adjusted under 35 U.S.C. 154(b) by 113 days.

(21) Appl. No.: 18/287,663

(22) PCT Filed: Mar. 10, 2022

(86) PCT No.: PCT/KR2022/003347

§ 371 (c)(1),
(2) Date: Oct. 20, 2023

(87) PCT Pub. No.: WO2022/225181

PCT Pub. Date: Oct. 27, 2022

(65) Prior Publication Data

US 2024/0189646 A1 Jun. 13, 2024

(30) Foreign Application Priority Data

Apr. 23, 2021 (KR) ..... 10-2021-0052724

(51) Int. Cl.
*A63B 5/16* (2006.01)
*A63B 21/02* (2006.01)

(52) U.S. Cl.
CPC ..... *A63B 5/16* (2013.01); *A63B 21/023* (2013.01)

(58) Field of Classification Search
CPC ..... A63B 5/16; A63B 21/023; A63B 22/0056; A63B 23/0405; A63B 21/00069; A63B 21/026; A63B 21/4035; A63B 22/0048; A63B 22/14; A63B 5/08
See application file for complete search history.

(56) References Cited

FOREIGN PATENT DOCUMENTS

| | | | |
|---|---|---|---|
| KR | 20-0287226 | Y1 | 8/2002 |
| KR | 10-2004-0068062 | A | 7/2004 |
| KR | 10-2005-0026842 | A | 3/2005 |
| KR | 10-2006-0003127 | A | 1/2006 |
| KR | 10-2011-0107702 | A | 10/2011 |
| KR | 10-2013-0043421 | A | 4/2013 |

OTHER PUBLICATIONS

International Search Report for PCT/KR2022/003347 mailed Jul. 8, 2022 from Korean Intellectual Property Office.

*Primary Examiner* — Andrew S Lo
(74) *Attorney, Agent, or Firm* — Revolution IP, PLLC

(57) ABSTRACT

The present invention relates to a jumping exercise equipment, and more particularly to a jumping exercise equipment including an elastically adjustable leaf spring and a coil spring to compensate for the ballistic force generated by the user's jumping exercise, wherein the present invention can provide a jumping exercise equipment that can compensate for the recoil force generated by the user's jumping exercise by including a recoil force complementary part with an elastic force in the lower part of the leaf spring.

1 Claim, 8 Drawing Sheets

[FIG. 1]
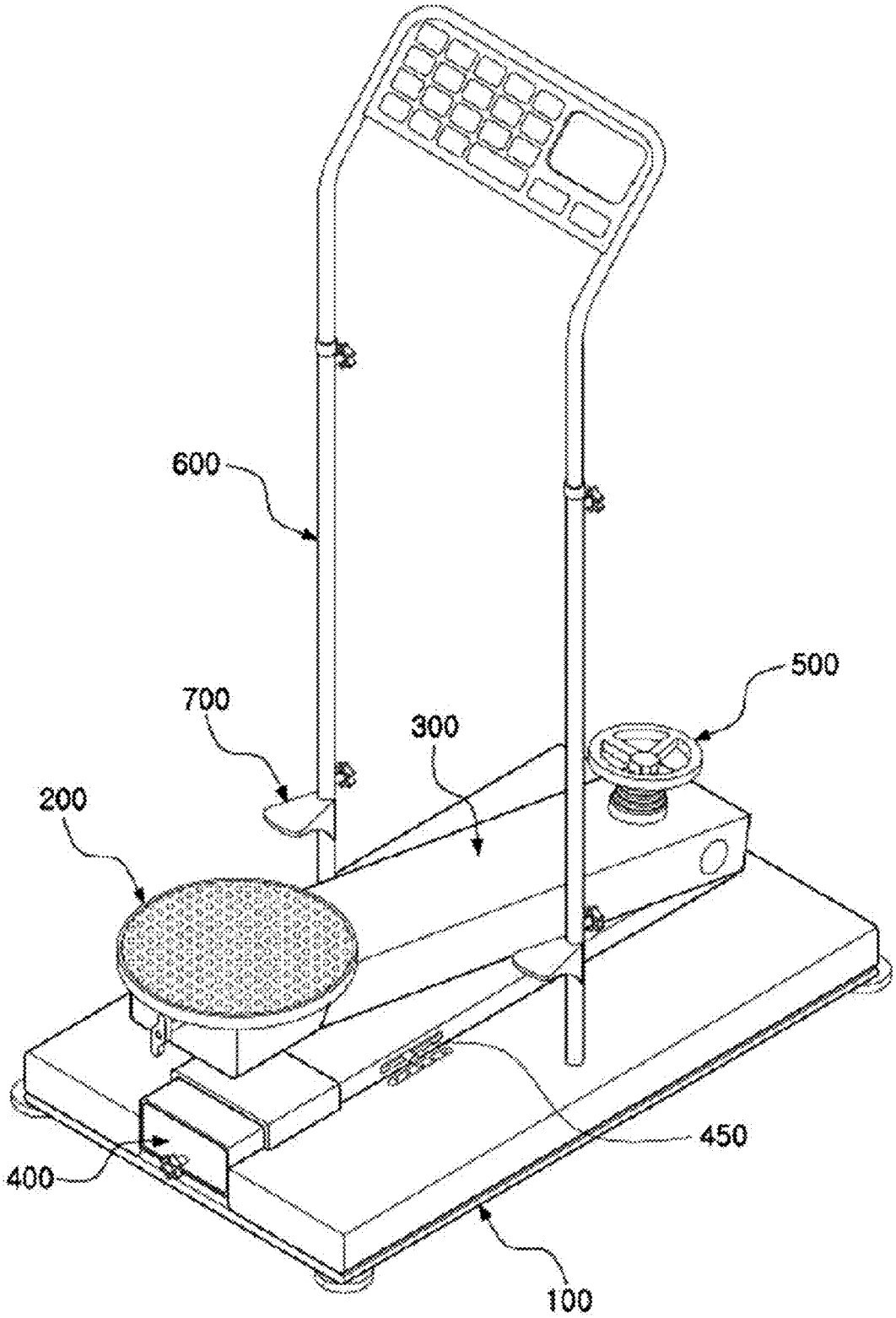

[FIG. 2]
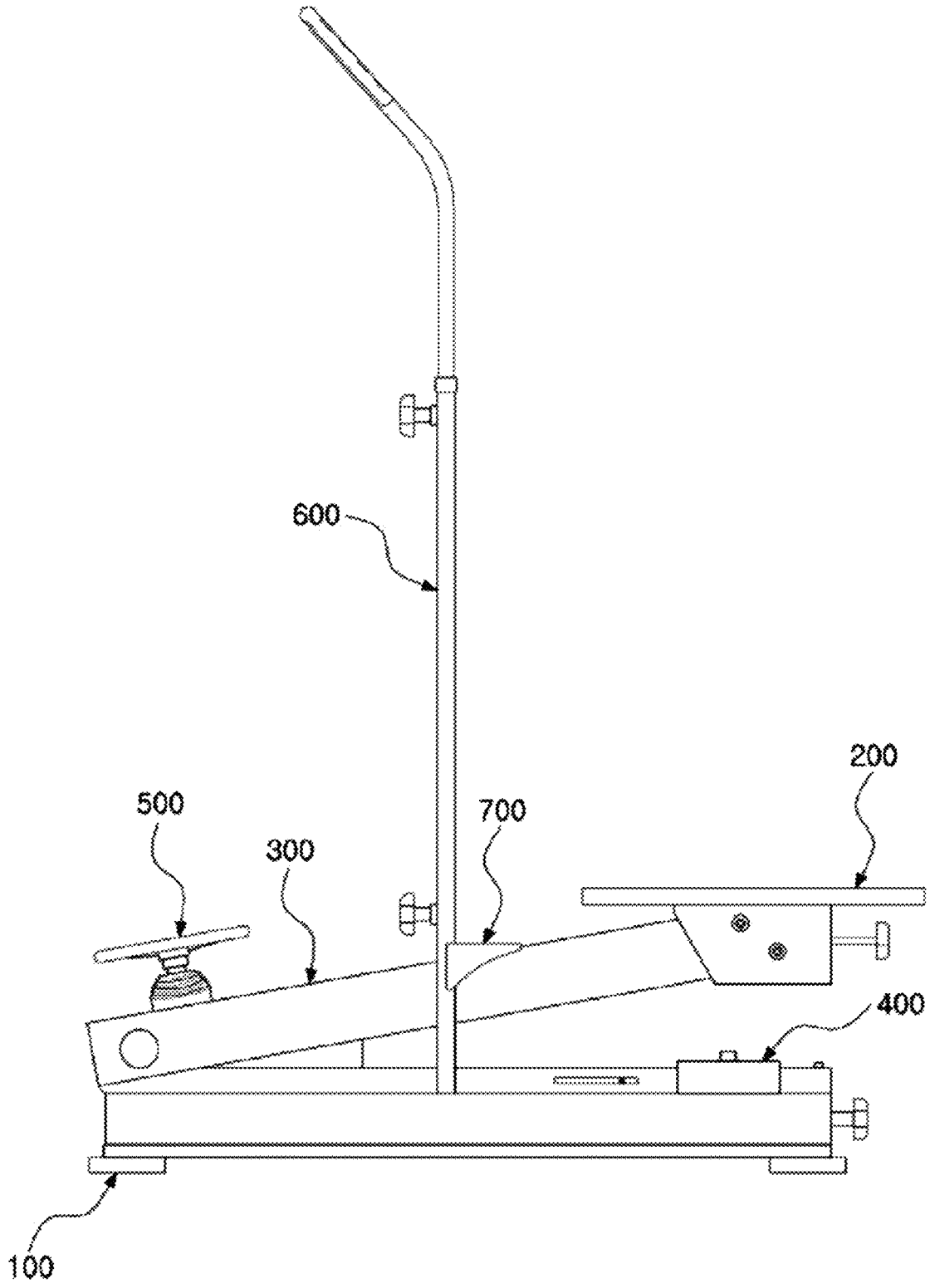

[FIG. 3]
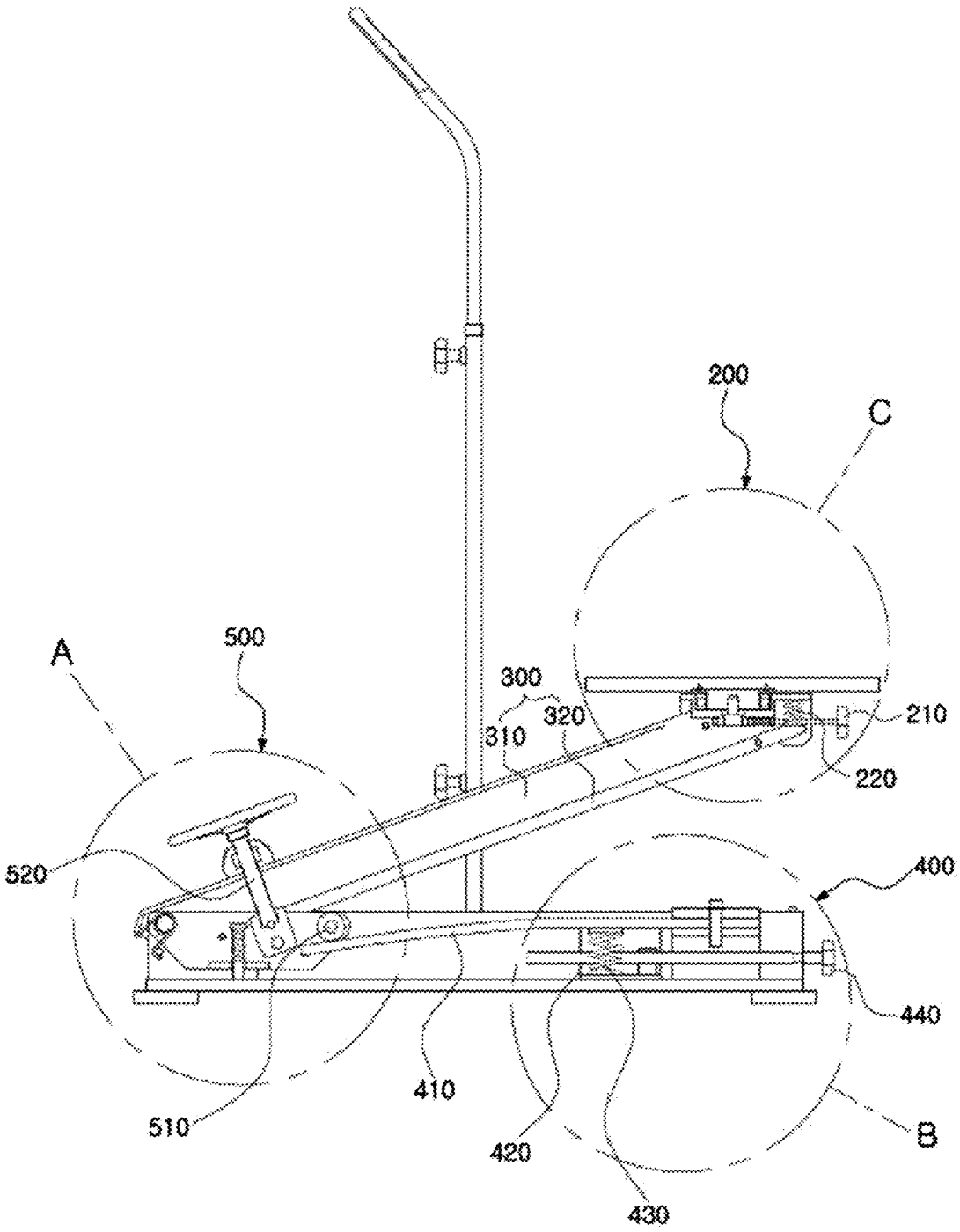

[FIG. 4]
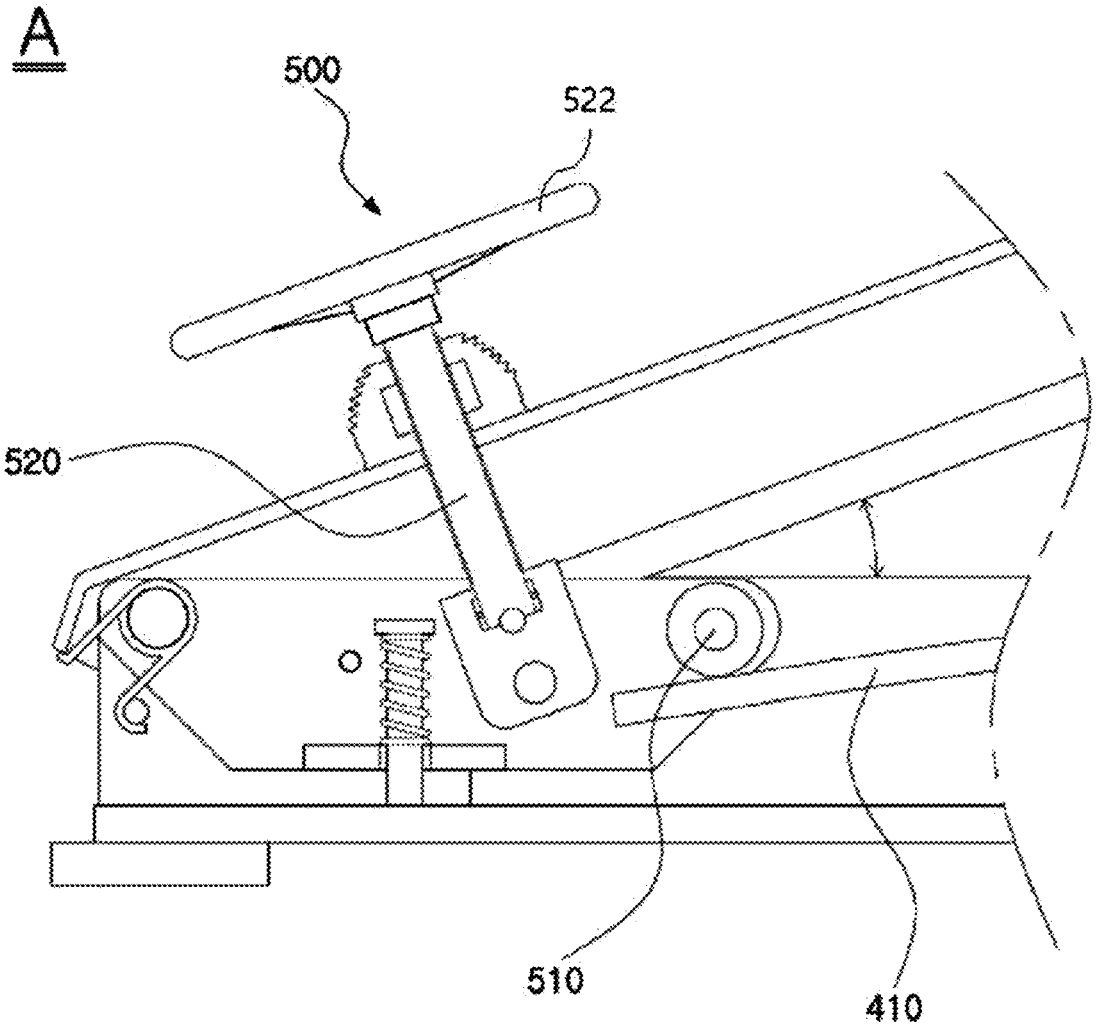

[FIG. 5]
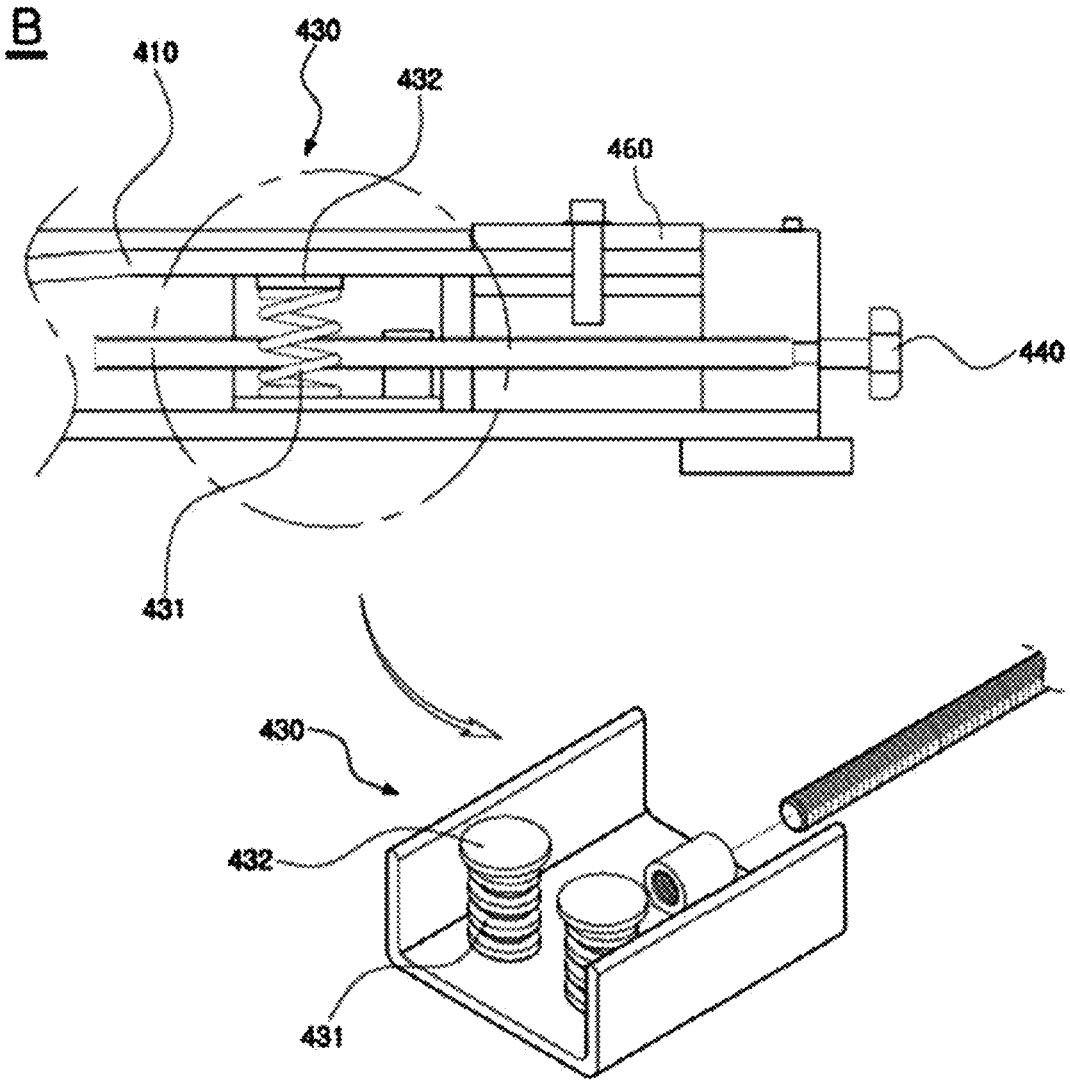

[FIG. 6]
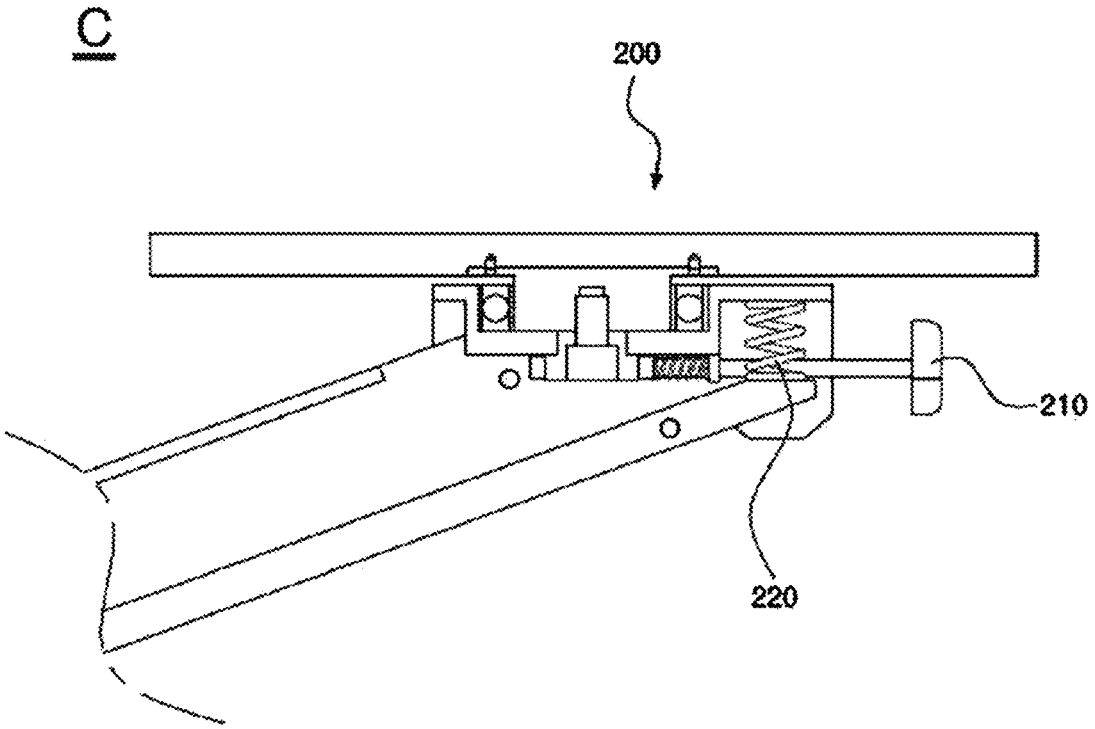

[FIG. 7]
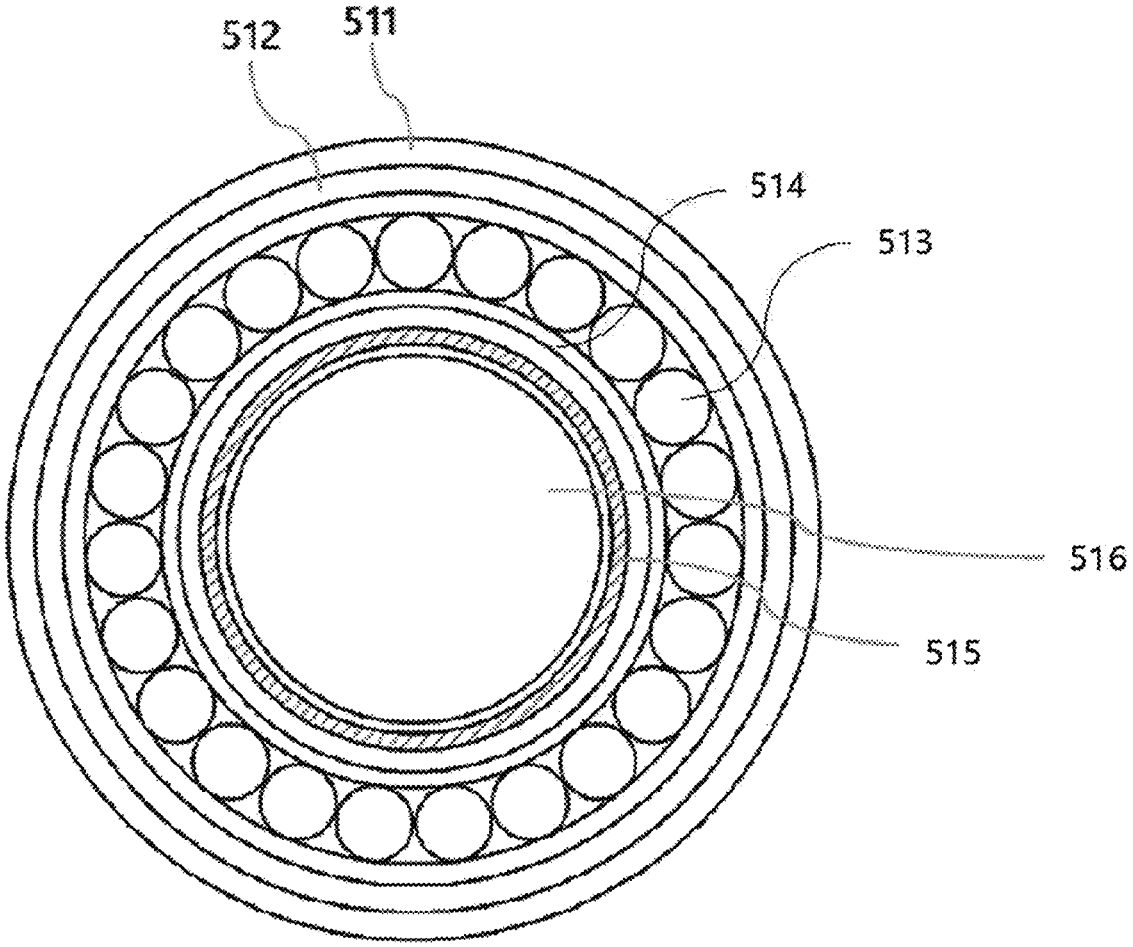

[FIG. 8]
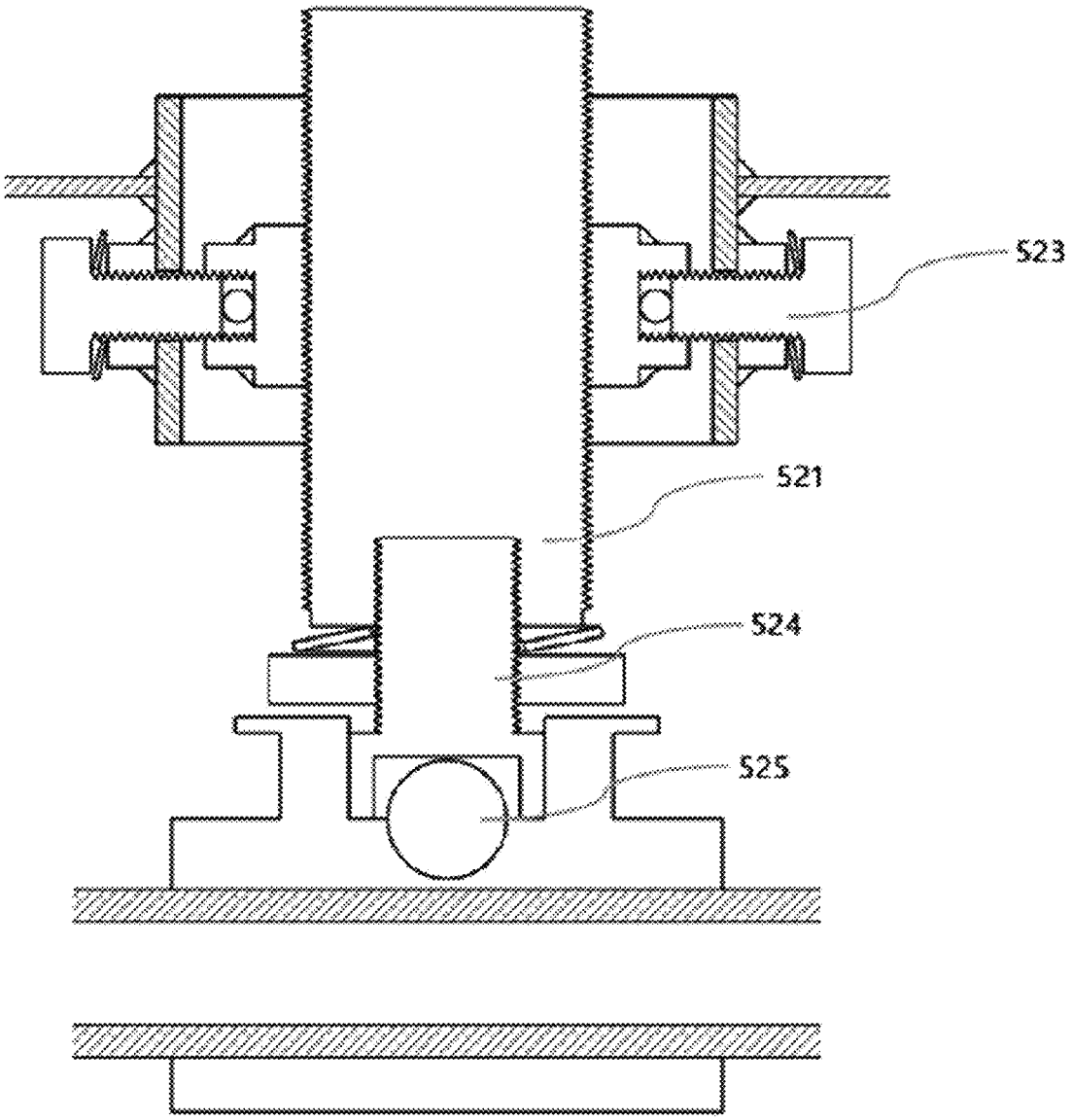

JUMPING EXERCISE EQUIPMENT

TECHNICAL FIELD

The present invention relates to a jumping exercise equipment, and in particular, to a jumping exercise equipment having an elasticity adjustable leaf spring and compensating for the spring force produced by the user's jumping exercise with a spring force compensation part.

BACKGROUND ART

Typically, jumping exercise equipment such as a trampoline is made up of a plurality of coil springs attached to an iron frame, which occupies a large area and has the disadvantage that the elasticity cannot be adjusted except by removing the coil springs.

Furthermore, the trampoline is made of fabric, which makes it difficult for the user to keep it horizontal, and due to the nature of the trampoline, it is difficult to mount a handle, which may cause injury to the user during use, and friction noise is generated due to the operation of a plurality of coil springs.

In order to address these problems, Korean Public Patent No. 10-2006-0003127 provides a jumping machine that includes an ignition device operated by a jumping exercise equipment, a body 12 in which a spring having a buffering effect is installed inside, and a top footboard 14 and a bottom footboard 16 installed in connection with the body 12 to transmit pressure to the user's body load to move the jumping exercise equipment.

Also in the case of Korean Publication Patent No. 10-2013-0043421, a lifting shaft (20) inserted inside a support tube (11) mounted vertically in the center of a seat (10) is supported and lifted by a first bearing (11B) and a first spring (11A), and a base (21) fixed on an upper part of the lifting shaft (20) is resiliently supported and lifted by a second spring (22A), and jumping-rotating exercise machine is disclosed, characterized in that a rotation shaft (30) is inclinedly mounted on a boss (22) of the base (21) and supported by a second bearing (22*b*), and an inclined footrest (31) is mounted on the upper end of the rotation shaft (30) so that the footrest (31) can be rotated and elevated.

A jumping exercise equipment is disclosed.

Meanwhile, Korean Publication Patent No. 10-1180510 discloses a jumping machine comprising a substrate (10) having a handle (11); a stepping plate (30) having a first end fixedly mounted on the substrate (10); and an elastic member (50) imparting an elastic force to the stepping plate (30); wherein the stepping plate portion (30) consists of a connecting member (310) which is fixed at one end on the substrate (10); a stepping plate (330) which is fixed at the other end of the connecting member (310) to rotate in a left and right direction; and a rotation angle measuring device (70) which measures a left and right rotation angle of the stepping plate (330); an accelerometer (90) for measuring the acceleration of the stepping plate (330) in the up and down directions; a load cell (40) for measuring the pressure of the stepping plate (330) on a portion of the substrate (10) wherein the lower end of the connecting member (310) of the stepping plate (30) is struck by a user's jumping; and a jumping machine for strengthening lower limb joints and muscles.

The prior art, however, suffers from structural and mechanical characteristics of the apparatus, such as high noise and friction, and high momentum even after the apparatus user jumps from the footrest of the apparatus, causing the entire apparatus, including the fixed plate, to move.

PRIOR ART DOCUMENTS

Patent Documents (Patent Document 0001) Korean Laid-open Patent Publication No. 10-2006-0003127
(Patent Document 0002) Korean Laid-open Patent Publication No. 10-2013-0043421
(Patent Document 0003) Korean Patent No. 10-1180510

DISCLOSURE

Technical Problem

The present invention aims to solve the above problems of the prior technique, and to provide a jumping exercise equipment that is capable of adjusting the elasticity of a plate spring and compensates for the recoil force generated by the user's jumping exercise by using a recoil force complementary part.

The present invention also aims to provide a jumping exercise machine that can be easily and safely used by a user, and that minimizes noise and friction sounds.

Furthermore, the present invention provides a jumping exercise machine that can be used stably for a long period of time by improving properties such as strength, impact resistance, abrasion resistance, hardness, durability, ozone resistance, and corrosion resistance of the elastic support part by using a polymer plastic material.

Technical Solution

In achieving the above objectives, the present invention provides a fixture plate (100) that forms the base of a vaulting exercise machine;

A stepping plate (200) on which a user steps while moving up and down on the fixed plate (100);

a stepping plate connecting movable member (300) that is rotatably connected to the fixed plate (100) on one side and rotatably connected to the stepping plate (200) on the other side, and that keeps the stepping plate (200) horizontal;

an elastic portion (400) provided on the fixed plate (100) and comprising a leaf spring (410) that provides an elastic force to the stepping plate connecting movable member (300) in response to a change in an angle that the stepping plate connecting movable member (300) makes with the fixed plate (100); and a leaf spring pressing portion (500) associated with the stepping plate connecting movable member (300) and acting as an action point in contact with a first side of the leaf spring (410), the stepping plate (200) comprising a stepping plate elastic portion (220) disposed between the stepping plate (200) and the stepping plate connecting movable member (300) and having an elastic force, in which the stepping plate elastic portion (220) contains a coil spring made of carbon steel connected at one end to the stepping plate connecting movable member (300); and a resilient support member made of polymeric plastic connected to an end of the coil spring and in contact with a portion of the treadmill (200), wherein the elastic portion (400) is provided at a lower end of the leaf spring (410), the leaf spring support member (420) being movable in the lengthwise direction of the leaf spring (410); a spring loaded complementary member (430) provided on the leaf spring support member (420), which is in conjunction with a portion of the leaf spring (410) and acts as a reference point and regulates the spring loaded force provided by the leaf spring (410) to the stepping plate connecting movable member (300), but which includes an elastic member to compensate for the spring loaded force. The present invention relates to the leaf spring support member (420), and further includes an elastic adjustment member (440) for adjusting the position of the leaf spring support member (420), The present invention provides a jumping exercise apparatus characterized in that the spring loaded complementary member (430) further comprises a coil spring (431) made of carbon steel connected on one side to the leaf spring support member (420); and an elastic support (432) made of a polymeric plastic, connected to an end of the coil spring (431), which is in contact with a portion of the leaf spring (410) and has a circular upper surface.

In one embodiment of the present invention, the elastic support member (432) of the polymeric plastic material of the stepping plate elastic portion (220) and the elastic support member (432) of the polymeric plastic material of the spring loaded complementary member (430) are composed of a thermoplastic resin; a thermoplastic rubber; a fiberglass; a lubricant; an acrylic emulsion; acrylate group-containing silane coupling agent and a copolymer of 2-hydroxyethyl acrylate (HEA); and a composition including an acrylate group-containing silane coupling agent, an acrylic acid monomer, and a copolymer of 2-hydroxyethyl acrylate (HEA).

In one embodiment of the present invention, the stepping plate connecting movable member (300) is further characterized in that it contains a main link arm (310) connecting the fixed plate (100) and the stepping plate (200); and a secondary link arm (320) linking the fixed plate (100) and the stepping plate (200) in a direction downstream of the main link arm (310) and horizontal to the main link arm (310).

In one embodiment of the present invention, the elastic portion (400) is coupled to the leaf spring support member (420), and is characterized in that it includes a reference point locating confirmation member (450) that is externally visible to enable positioning of the leaf spring support portion (420).

In one embodiment of the present invention, the elastic portion (400) is formed at the opposite end of the leaf spring (410) from the leaf spring pressing portion (500) and comprises a leaf spring lock (460) for securing the leaf spring (410). In one embodiment of the present invention, the leaf spring pressing portion (500) is connected to a first end of the leaf spring (410) and includes an actuating portion (510) that acts as an actuation point; and a reference angle adjustment portion (520) that is connected to the stepping plate connecting movable member (300) and the actuating portion (510) and that adjusts an initial angle that the stepping plate connecting movable member (300) makes with the fixed plate (100), in which the actuating portion (510) includes a housing (511) positioned at the far side and in touch with the leaf spring (410), an outer ring (512) formed on an inner side of the housing (511), and a bearing (513) formed on an inner side of the outer ring (512), an inner ring (514) being formed on an inner side of the bearing (513), a tube (515) being formed on an inner side of the inner ring (514), and an actuating shaft (516) being formed on an inner side of the tube (515) as an axis of rotation.

In one embodiment of the present invention, the reference angle adjustment portion (520) is characterized by an angle adjustment shaft (521) which is an axis of rotation, an angle adjustment handle (522) for rotating the angle adjustment shaft (521), and a axial engagement portion (523) for engaging with a chosen portion of the angle adjustment shaft (521), an angle adjustment end (524) in the form of a bolt for engaging a lower end of the angle adjustment shaft (521), and a ball bearing (525) for engaging a lower end of the angle adjustment end (524).

In one embodiment of the present invention, the leaf spring (410) is organized in a tapered form with a different thickness on a first side and a different thickness on the other side.

Advantageous Effects

The present invention may provide a jumping exercise equipment that can complement a spring force generated by a user's jumping exercise by equipping a spring force complementary part with an elastic force in the lower part of a plate spring.

The present invention can also minimize the noise and impact generated during a jumping exercise, and can optionally provide a preferred exercise between a jumping exercise and a waist rotation exercise by provision of a fixed lever that can stop the rotation of the rotatable stepping plate.

The present invention can also provide an elastic part of the stepping plate, which can cushion the impact generated during the jumping exercise in the first place, thereby reducing the impact on the user.

The present invention also enables long-term stable use of the jumping exercise equipment by enhancing properties such as strength, impact resistance, abrasion resistance, hardness, durability, ozone resistance, and corrosion resistance by using a polymer plastic material as the material of the elastic support part.

The present invention also secures the stability of the movement by keeping the angle of the main linkage arm and the auxiliary linkage arm with the stepping plate constant at all times, and by separately installing the coil spring and the elastic support part, it has the effect of reducing the launch force generated by the leaf spring and at the same time making it easy to move the part corresponding to the action point of the leaf spring.

Furthermore, by having a reference point location checking part, it has the effect of being able to intuitively check where the position of the part corresponding to the action point of the plate spring is, and the action part by installing the reference angle adjustment part separately, but forming the part corresponding to the action point with a rolling bearing, it has the effect of improving the durability of the plate spring.

The present invention also has the effect of helping a person to safely step on the stepping plate to practice a jumping exercise by providing a pole on which a stepping plate is formed.

DESCRIPTION OF DRAWINGS

FIG. 1 is a front perspective view of a vaulting exercise apparatus according to one embodiment of the present invention.

FIG. 2 is a side view of FIG. 1.

FIG. 3 is an interior view of FIG. 2.

FIG. 4 is an expanded view of part A of FIG. 3.

FIG. 5 is an enlarged view of part B of FIG. 3.

FIG. 6 is an enlarged view of part C of FIG. 3.

FIG. 7 is a functional embodiment of the present invention.

FIG. 8 is an embodiment of the reference adjustment part of the present invention.

BEST MODE

The present invention will be described in detail with reference to the following embodiments. The terminology, embodiments, and the like used in the present invention are merely illustrative for the purpose of describing the invention more particularly and assisting the understanding of one of ordinary skill in the art, and should not be construed as limiting the scope of the present invention.

Technical and scientific terms used herein, unless otherwise defined, have the meanings commonly understood by one of ordinary skill in the art to which this invention belongs.

FIG. 1 is a perspective view of a jumping exercise equipment according to one embodiment of the present invention, FIG. 2 is a side view of FIG. 1, FIG. 3 is an interior view of FIG. 2, and FIG. 4 is an expanded view of portion A of FIG. 3, FIG. 5 is an expanded view of portion B of FIG. 3, FIG. 6 is an expanded view of portion C of FIG. 3, FIG. 7 is an embodiment of an operating portion, and FIG. 8 is an embodiment of a reference adjustment portion.

A jumping exercise equipment according to one embodiment of the present invention is an exercise equipment that allows a user to stand up and perform a jumping exercise, but can also be operated indoors by using less space and minimizing noise and shock generated during the exercise.

As shown in FIGS. 1 to 3, a jumping exercise equipment according to one embodiment of the present invention consists of a fixed plate (100), a stepping plate (200), and a stepping plate connecting movable member (300) in a jumping exercise equipment, the elastic portion (400), and a leaf spring pressing portion (500), wherein the elastic portion (400) includes the leaf spring (410), leaf spring support member (420), the spring loaded complementary member (430), and an elastic adjustment member (440).

Wherein the fixed plate (100) forms the base of the jumping exercise equipment, the fixed plate (100) is the part where the jumping exercise equipment according to one embodiment of the present invention is in contact with the ground and serves as a base to support the jumping exercise equipment according to one embodiment of the present invention.

Although the term 'plate' is used herein, it is not meant to limit the fixed plate (100) to the shape of a plate, and it is of course also possible to realize the fixed plate (100) in various shapes as a part that forms the base of the jumping exercise apparatus according to one embodiment of the present invention.

The stepping plate (200) is a part of the top of the fixed plate (100) that the users step on.

That is, the stepping plate (200) acts as a stepping stone for the user to stand on and perform a jumping exercise. For this purpose, the stepping plate (200) is movable up and down.

The stepping plate connection movable member (300) is rotatably connected to the fixed plate (100) on a first side, and is rotatably connected to the stepping plate (200) on a second side, while keeping the stepping plate (200) horizontal.

That is, the stepping plate connecting movable member (300) makes a reciprocating movement (rotation within a certain angle range) around the point where the stepping plate connecting movable member (300) is connected to the fixed plate (100), and the stepping plate (200) connected to the stepping plate connecting movable member (300) makes an up and down movement according to the angle at which the stepping plate connecting movable member (300) forms with the fixed plate (100). Here, the up and down movement is not meant to be an exact vertical movement, but can be a reciprocating movement along an arc.

In this case, one end of the stepping plate connecting movable member (300) may be pivotably axially fixed with the fixed plate (100), and the other end of the stepping plate connecting movable member (300) may be pivotably axially fixed with the stepping plate (200). Here, the axial connection may be hinged.

The elastic portion (400) is provided on the fixed plate (100), wherein the elastic portion (400) plays a role of transmitting an elastic force to the stepping plate connecting movable member (300), and the elastic portion (400) is mounted on the fixed plate (100) to make the fixed plate (100) a reference.

A leaf spring (410) provides an elastic force to the stepping plate connecting movable member (300) in response to a change in an angle at which the stepping plate connecting movable member (300) forms with the fixed plate (100).

The leaf spring (410) is fixed on one side, and the fixed portion corresponds to a force point.

A leaf spring support member (420) is provided on the lower part of the leaf spring (410), and is movable in the longitudinal direction of the leaf spring (410).

The spring loaded complementary member (430) is provided on the leaf spring support member (420), which is in contact with a portion of the leaf spring (410) and acts as a reference point to adjust the elastic force provided by the leaf spring (410) to the stepping plate connecting movable member (300).

That is, by moving the leaf spring support member (420), it is able to change the position at which the spring loaded complementary member (430) is in contact with the leaf spring (410), which in turn can change the position corresponding to the reference point of the leaf spring (410), thereby adjusting the elastic force of the portion corresponding to the action point.

In this case, the spring loaded complementary member (430) includes an elastic member to complement the elastic force.

The elasticity adjustment member (440) is connected to the leaf spring support member (420) and can adjust the position of the leaf spring support member (420).

That is, the elastic adjustment member (440) shifts the location of the leaf spring support member (420) to adjust the portion (corresponding to a reference point) where the spring loaded complementary member (430) contacts the leaf spring (410).

In this case, an indicator (strong, weak, etc.) of how to operate (rotate in which direction, etc.) to control the elastic force may be provided on a portion where a handle or the like required for operation of the elastic adjustment member (440) is positioned.

As shown in FIGS. 3, 4, 7, and 8, a leaf spring pressing portion (500) is linked to the stepping plate connecting movable member (300), and it contacts a first side of the elastic portion (400) and acts as an action point.

That is, the leaf spring pressing portion (500) acts as an actuation point to transfer an elastic force to the stepping plate connecting movable member (300).

The leaf spring depression portion (500) may include an actuating portion (510) that is in contact with one end of the leaf spring (410) and serves as an actuation point; and a reference angle adjustment portion (520) that is connected to the stepping plate connecting movable member (300) and the actuating portion (510) and controls an initial angle that the stepping plate connecting movable member (300) makes with the fixed plate (100).

The actuating portion (510) may comprise a housing (511) located at the outermost side and in contact with the leaf spring (410), an outer ring (512) formed on an inner side of the housing (511), and a bearing (513) formed on an inner side of the outer ring (512), an inner ring (514) formed on an inner side of the bearing (513), a tube (515) formed on an inner side of the inner ring (514), and an actuating shaft (516) formed on an inner side of the tube (515) as an axis of rotation.

That is, as shown in FIG. 7, the nature of the mechanism is such that if the lever action is instantaneously released at the maximum point of compression of the lever, the direction of rolling of the bearing should be instantaneously turned to the opposite direction due to the straightening action of the leaf spring (410), which was flexed due to the simultaneous instantaneous compression and release.

In conventional structures, however, it is difficult to instantly change the direction of the bearing, loosening of the fastening structure occurs due to the applied load, durability is reduced, and noise is generated.

The present invention utilizes an actuating portion (510) composed of a housing (511), an outer ring (512), a bearing (513), an inner ring (514), a tube (515), and an actuating shaft (516) to enable immediate change of direction of the bearing, prevent loosening of the fastening structure, improve durability, and prevent noise.

That is, by organizing the actuating shaft, cylindrical tube, inner ring, cylindrical bearing, and outer ring into a mixed structure, the driving direction can be freely switched even when the bearing is switched in an instant by the action and reaction of the mechanism, so that it can be operated without friction and load.

In this case, the reference angle adjustment portion (520) is composed of an angle adjustment shaft (521) that is a rotation axis, an angle adjustment handle (522) for rotating the angle adjustment shaft (521), and an axial engagement portion (523) for engaging with a selected portion of the angle adjustment shaft (521), an angle adjustment end (524) in the form of a bolt that engages a lower end of the angle adjustment shaft (521), and a ball bearing (525) that is coupled to a lower end of the angle adjustment end (524).

Through the rotation of the angle adjustment handle (522), the angle adjustment shaft (521) is rotated, and the angle formed by the stepping plate connecting movable member (300) and the elastic portion (400) is adjusted. In this case, the axial engagement portion (523) can fix the swing of the angle adjustment shaft (521) to prevent the angle adjustment shaft (521) from deviating even in the event of an impact generated when using the apparatus.

The ball bearing (525) can distribute the impact of the vertical direction of the angle adjustment shaft (521) to distribute the impact of the reference angle adjustment part (520), which has been prone to breakage due to the impact of conventional instruments, to improve durability.

As illustrated in FIG. 3, the stepping plate (200) of the jumping exercise equipment according to one embodiment of the present invention is featured to be rotatable, and may further include a locking lever (210) to lock the stepping plate (200) from rotating.

In order to rotate the stepping plate (200), a ball bearing may be mounted on the lower part of the stepping plate (200) (see FIG. 6).

This is intended to make it possible to selectively perform the desired exercise among the jumping exercise and the waist rotation exercise, and since the rotation of the stepping plate (200) when performing the jumping exercise may be dangerous for the exerciser, it is desirable to have a fixed lever (210) that can keep the stepping plate (200) from rotating when the exerciser wishes to perform the jumping exercise.

As shown in FIG. 3, the stepping plate (200) of a jumping exercise equipment according to one embodiment of the present invention may be provided between the stepping plate (200) and a stepping plate connecting movable member (300), and may further comprise a stepping plate elastic portion (220) having an elastic force.

The stepping plate elastic portion (220) is provided on the lower part of the stepping plate (200), and acts as a primary cushion for the impact generated during a jumping exercise, i.e., reducing the impact on the user's foot. This helps to ensure a smooth jumping motion (see FIG. 6).

The stepping plate elastic portion (220) may include a coil-spring connected at one side to the stepping plate connecting movable member (300) and a resilient support member connected to an end of the coil-spring and in contact with a portion of the stepping plate (200).

The coil spring may be made of a carbon steel material, and the elastic support portion may be made of a polymeric plastic material.

As shown in FIG. 3, the stepping plate connecting movable member (300) of a jumping exercise equipment in accordance with one embodiment of the present invention may include a main linkage arm (310) linking the fixed plate (100) and the stepping plate (200), and an assistant linkage arm (320) linking the fixed plate (100) and the stepping plate (200) in a direction downward of the main linkage arm (210) and parallel to the main linkage arm (210).

In this case, it is desirable that the distance between the linkage axis connected to the fixed plate (100) and the linkage axis connected to the stepping plate (200) of the main linkage arm (310) is equal to the distance between the linkage axis connected to the fixed plate (100) and the linkage axis connected to the stepping plate (200) of the assistant linkage arm (320).

This is due to the fact that the angle of the stepping plate (200) with the ground is maintained to be constant at all times if an extension of the connecting shaft connected with the fixed plate (100) of the main link arm (310) and an extension of the connecting shaft connected with the fixed plate (100) of the assistant link arm (320) is in parallel with an extension of the connecting shaft connected with the stepping plate (200) of the main link arm (310) and an extension of the connecting shaft associated with the stepping plate (200) of the assistant link arm (320) (refer to parallelogram shape).

As shown in FIGS. 3 and 5, the spring loaded complementary member (430) of a jumping exercise equipment in accordance with one embodiment of the present invention may comprise a coil spring (431) connected at one end to the leaf spring support member (420), and an elastic support member (432) connected to an end of the coil spring (431) and acting as a reference point in contact with a portion of the leaf spring (410).

The spring loaded complementary member (430) also needs to transmit an elastic force to the portion in contact with the leaf spring (410) in order to complement (reduce) the recoil force produced by the leaf spring (410), and also needs to reduce the frictional force of the portions contacting the leaf spring (410) in order to move the portions in contact with the leaf spring (410).

For this purpose, the coil spring (431) may be made of a carbon steel material, and the elastic support member (432) may be made of a polymeric plastic material.

Also as shown in FIG. 5, the elastic portion (400) may be configured to include a leaf spring lock (460) that is formed at the other end of the leaf spring (410) that is opposite the contact point where the leaf spring pressing portion (500) contacts, thereby securing the leaf spring (410).

By securely fixing the leaf spring (410) to the elastic portion (400) through the leaf spring lock (460), loosening of the leaf spring (410) that may occur due to shocks or jolts generated by use of the instrument can be prevented, durability can be improved since the leaf spring (410) can be securely fixed, and injury to users that may occur if the leaf spring (410) is loosened can be prevented in advance. In this case, the leaf spring lock (460) may comprise a bolt and a nut.

The elastic support member (432) of the polymeric plastic material of the stepping plate elastic portion (220) and the elastic support member (432) of the polymeric plastic material of the spring loaded complementary member (430) are formed from a thermoplastic resin; a thermoplastic rubber; a glass fiber; a lubricant; an acrylic emulsion; a copolymer of an acrylate group-containing silane coupling agent and 2-hydroxyethyl acrylate (HEA); and a component of a composition comprising an acrylate group-containing silane coupling agent, an acrylic acid monomer, and a copolymer of 2-hydroxyethyl acrylate (HEA).

By selecting a polymeric plastic material as the material of the elastic support member, characteristics including strength, impact resistance, abrasion resistance, hardness, durability, ozone resistance, and corrosion resistance can be improved, thereby enabling long-term stable use of a jumping exercise equipment.

The composition comprises 100 parts by weight of a thermoplastic resin, 10 to 20 parts by weight of a thermoplastic rubber, 1 to 10 parts by weight of a glass fiber, 1 to 10 parts by weight of a lubricant, and 1 to 10 parts by weight of an acrylic emulsion, 1 to 10 parts by weight of a copolymer of an acrylate group-containing silane coupling agent and 2-hydroxyethyl acrylate (HEA), and 1 to 10 parts by weight of a copolymer of an acrylate group-containing silane coupling agent, acrylic acid monomer, and 2-hydroxyethyl acrylate (HEA).

Thermoplastic resins may be used, including, without limitation, polyolefins, polyester, nylon, polyvinyl chloride, polyurethane, acrylic resins, acrylonitrile-butadiene-styrene copolymers (ABS), polycarbonate, and acetal resins.

The thermoplastic rubber is used to provide elasticity, weather resistance, and ozone resistance, and styrene-based thermoplastic rubber, olefin-based thermoplastic rubber, urethane-based thermoplastic rubber, amide-based thermoplastic rubber, ester-based thermoplastic rubber, and the like are used without limitation.

In particular, an olefin-based thermoplastic rubber is olefin-based resin such as preferably used in which an polyethylene, polypropylene, polystyrene, etc. is dynamically crosslinked or blended with a rubber such as EPDM (ethylene-propylene-diene rubber), natural rubber, SBR (styrene-butadiene rubber), etc.

Thermoplastic rubber is preferably used in an amount of 10 to 20 parts by weight for 100 parts by weight of thermoplastic resin, and when the content of thermoplastic rubber is less than 10 parts by weight, the addition effect is insignificant, and when it exceeds 20 parts by weight, the strength and heat resistance of the elastic support member are rather reduced.

The glass fiber is employed to impart strength and heat resistance, and is preferably used in an amount of 1 to 10 parts by weight relative to 100 parts by weight of the thermoplastic resin. If the content of glass fiber is below 1 part by weight, the effect of the addition is insignificant, and if it exceeds 10 parts by weight, the interfacial properties, strength and heat resistance of the elastic support are rather reduced.

The above lubricant plays a role in improving wear resistance, and paraffin-based oils, naphthenic oils, animal and vegetable oils, synthetic oils, greases, graphite, and the like can be used.

The contents of the lubricant are preferably 1 to 10 parts by weight for 100 parts by weight of the thermoplastic resin, and when the contents are less than 1 part by weight, the effect of the addition is insignificant, and when the contents exceed 10 parts by weight, the elastic support part manufactured is rather degraded in mechanical properties and thermal properties.

The acrylic emulsion is used for providing adhesion and elasticity, and the acrylic-based resins used include polymethylmethacrylate, polyethylmethacrylate, polymethylacrylate, polyethylacrylate, acrylic copolymer, and the like.

The amount of acrylic emulsion is preferably 1 part to 10 parts per 100 parts of thermoplastic resin, and if the amount is less than 1 part, adhesion and elasticity may not be sufficiently expressed, and if the amount exceeds 10 parts, strength is rather reduced.

The copolymer of the above acrylate group-containing silane coupling agent and the 2-hydroxyethyl acrylate copolymer can enhance the adhesion of the components in the composition, improve durability, flame retardancy, heat resistance, etc.

Examples of such acrylate group-containing silane coupling agents include 3-methacryloxypropylmethyldimethoxysilane, 3-methacryloxypropyltrimethoxysilane, 3-methacryloxypropylmethyldiethoxysilane, 3-methacryloxypropyltrimethoxysilane, 3-acryloxypropyltrimethoxysilane, methacryloxymethyltriethoxysilane, methacryloxymethyltrimethoxysilane, etc.

The ratio by weight of the acrylate group-containing silane coupling agent and 2-hydroxyethyl acrylate is preferably 20 to 40:60 to 80, and the durability, heat resistance, etc. of the composite can be maximized in the numerical range.

The amount of the copolymer is preferably 1 to 10 parts by weight relative to 100 parts by weight of the thermoplastic resin, and when the amount is less than 1 part by weight, the effect of addition is insignificant, and when the amount exceeds 10 parts by weight, the intensity is reduced.

The copolymer of the acrylate group-containing silane coupling agent, acrylic acid monomer and 2-hydroxyethyl acrylate (HEA) can enhance the adhesion of components in the composition, improve durability, flame retardancy, heat resistance and the like.

The acrylic acid monomers are acrylic acid, methacrylic acid, methyl acrylic acid, ethyl acrylic acid, butyl acrylic acid, 2-ethyl nucleosyl acrylic acid, decyl acrylic acid, methyl methacrylic acid, ethyl methacrylic acid, butyl methacrylic acid, 2-ethyl nucleosyl methacrylic acid, decyl methacrylic acid, etc.

The ratio by weight of the acrylate group-containing silane coupling agent, acrylic acid monomer and 2-hydroxyethyl acrylate is preferably 2 to 10:100:2050, and the durability, heat resistance, etc. of the composition can be maximized in the numerical range.

The contents of the copolymer are preferably 1 to 10 parts by weight relative to 100 parts by weight of the thermoplastic resin, and when the contents are less than 1 part by weight, the addition effect is insignificant, and when the contents exceed 10 parts by weight, the strength decreases.

The compositions may further comprise an epoxy compound made by mixing bisphenol A (BPA), trimethylolpropane triglycidyl ether (TMPTGE), 1,6-hexanediol diglycidyl ether (HDGE), and butylglycidyl ether (BGE).

The epoxy compound may comprise 5 to 30 parts trimethylolpropane triglycidyl ether, 5 to 20 parts 1, 6-nucleated dioldiglycidyl ether, and 5 to 20 parts butylglycidyl ether, based on 100 parts bisphenol A by weight.

The amount of the epoxy compound is preferably 1 to 10 parts by weight relative to 100 parts by weight of the thermoplastic resin, and when the amount is less than 1 part by weight, the effect of addition is insignificant, and when the amount exceeds 10 parts by weight, the strength decreases.

As illustrated in FIG. 1, the elastic portion (400) of a jumping exercise equipment in accordance with one embodiment of the present invention is connected to the leaf spring support member (420) and may contain a reference point locating confirmation member (450) that is externally observable and enables positioning of the leaf spring support member (420).

The reference point locating confirmation member (450) is necessary in order to regulate the strength of the jumping exercise, and it is preferable to be able to check the current position of the spring loaded complementary member (430) so that it can be determined to what extent the jumping exercise apparatus according to one embodiment of the present invention is set to an elastic force, and to be able to intuitively check this.

For this purpose, it is possible to form a projection on the side corresponding to the position of the spring loaded complementary member (430) in the leaf spring support member (420), and to form a movable guide groove from which the projection protrudes outward, so that when the position of the projection is checked, it is possible to check the position of the spring loaded complementary member (430). (refer to FIG. 1).

As illustrated in FIG. 3, a leaf spring pressing portion (500) of a jumping exercise equipment in accordance with one embodiment of the present invention is in contact with a first end of the leaf spring (410), connecting the stepping plate connecting movable member (300) with an actuation portion (510) that functions as an actuation point, and may comprise a reference angle adjustment portion (520) that adjusts an initial angle that the stepping plate connecting movable member (300) makes with the fixed plate (100).

The reference angle adjustment part (520) is for adjusting the angle that the stepping plate connecting movable member (300) makes with a portion of the actuation part (510) that corresponds to an actuation point of the fixed plate, centering on the portion where the stepping plate connecting movable member (300) is connected to the fixed plate.

For example, the handle can be constructed to adjust the angle formed between the plate on which the actuating portion (510) is based and the stepping plate connecting movable member (300) by rotating the handle.

For this purpose, various bolts, nuts, connecting shafts, pins, bearings, and other mechanical connections may be utilized.

The leaf springs (410) may be configured with the same thickness, or may be formed in a shape where the thickness decreases from one side to the other.

The present exercise equipment is structured to utilize the elasticity of the leaf spring as the main elasticity, and the coil spring as a cushioning member. In this case, the elastic force of the leaf spring is decided by the cross-sectional area, and the elastic force of the coil spring is decided by the material and structure. Thus, the elastic force can be generated by reinforcing or relaxing these two forces, and the reaction speed of the elastic force can be configured to be adjustable.

The leaf spring (410) may be shaped such that the thickness of the leaf spring (410) decreases from one side to the other, i.e., tapered, to adjust the elastic strength and flexibility to provide optimized elasticity.

As illustrated in FIG. 1, a jumping exercise equipment in accordance with one embodiment of the present invention may comprise a pole (600) connected to the fixed plate (100) in a vertical upper direction of the fixed plate (100), and a footrest (700) connected to the pole (600) and movable and fixable along the pole (600).

The pole (600) is meant to enable an exerciser to safely perform a vaulting exercise while holding on to it with their hands, and the footrest (700) serves as an assistance for safely stepping onto the stepping board (200) to perform a vaulting exercise.

In addition, the jumping exercise equipment of the present invention may also comprise, although not shown in the figures, an elastic mat and suction rubber feet that are attached to the lower end of the fixed plate (100).

The exercise apparatus may produce annoying interstitial noise due to the shock of the load and the shaking of the apparatus, which may become a point of contention. In the case of the jumping exercise equipment of the present invention, interfloor noise can be prevented by buffering between the floor and the equipment through an elastic mat, and interfloor noise that can be generated by shaking can be prevented by fastening the equipment to the floor through an adsorption rubber foot. Therefore, no interfloor noise is produced even when exercising with the equipment, preventing disputes in advance.

In addition, a bolting hole for mounting the moving wheels is provided at the bottom of the fixed plate (100), so that movement can be carried out more conveniently by mounting the wheels through the action of combining the bolts of the wheels with the bolting hole when the wheels are normally detached and the apparatus is to be used, and when movement is required for moving or changing the position.

The present invention will be further described with reference to the following embodiments and comparative examples. The following embodiments are illustrative of the present invention, and the present invention is not limited by the following embodiments.

Embodiment 1

100 parts polyurethane, 15 parts thermoplastic rubber blended from 70 parts polyethylene and 30 parts styrene-butadiene rubber, 5 parts glass fiber, 5 parts paraffin oil, and 5 parts polymethylmethacrylate emulsion, 5 parts of a copolymer of 3-methacryloxypropyltrimethoxysilane and 2-hydroxyethyl acrylate (HEA), and 5 parts of a copolymer of 3-methacryloxypropyltrimethoxysilane, acrylic acid, and 2-hydroxyethyl acrylate (HEA) were mixed and extruded to prepare the polyurethane composition.

(Example 2)

The polyurethane composition was made in the same manner as in Example 1, except for the additional use of five weight parts of an epoxy compound prepared by mixing bisphenol A (BPA), trimethylolpropane triglycidyl ether (TMPTGE), 1,6-hexanediol diglycidyl ether (HDGE), and butylglycidyl ether (BGE).

Comparative Example 1

A polyurethane composition was made by the same method as in Example 1, except that a copolymer of 3-methacryloxypropyltrimethoxysilane and 2-hydroxyethyl acrylate (HEA) was not used.

Comparative Example 2

The polyurethane composition was made in the same manner as in Example 1, except that a polymethylmethacrylate emulsion gum was not used.

Tensile strength, heat resistance, coefficient of friction, and acid resistance of the polyurethane compositions prepared from the above embodiments and comparative examples were measured, and the results are shown in Table 1 below.

The tensile strength was measured in accordance with ASTM D 638, and the heat resistance was evaluated by heating the compositions for 3 hours in a hot air circulating furnace maintained at 100° C., and the yellowing of the composition was visually observed and labeled as excellent, good, fair, and poor.

The coefficient of friction was calculated by measuring the tangential friction force produced by vertical load and rotation at room temperature using a roller-and-disk tester.

The acid resistance was evaluated by soaking the composition in 10 wt % sulfuric acid at room temperature for 5 days, and then observing the state of the composition and labeling it as excellent, good, fair, or poor.

TABLE 1

| Classification | Example 1 | Example 2 | Comparative Example 1 | Comparative Example 2 |
|---|---|---|---|---|
| Tensile Strength (kg/cm$^2$) | 340 | 350 | 265 | 275 |
| Heat Resistance | Excellent | Excellent | Poor | Poor |
| Coefficient of Friction | 0.6 | 0.4 | 1.2 | 1.1 |
| Acid resistance | Excellent | Excellent | Poor | Poor |

From the above results in Table 1, it may be seen that Examples 1 and 2 have superior tensile strength, heat resistance, abrasion resistance, and acid resistance.

In contrast, it can be seen that Comparative Examples 1 and 2 are inferior to the embodiments in the above properties.

EXPLANATION OF SYMBOLS

| | | |
|---|---|---|
| 100: Fixing plate | 200: Stepping plate | 210: Fixed lever |
| 220: Tread plate elastic member | 300: Tread plate linkage movable member | 310: Main link arm |
| 320: Assistant link arm | 400: Elastic part | 410: Leaf spring |
| 420: Plate spring support | 430: Shock absorber | 431: Coil spring |
| 432: Elastic support part | 440: Elastic adjustment part | 450: Reference point locator |
| 460: Leaf spring lock | 500: Leaf spring pressing part | 510: Operating part |
| 511: Housing | 512: Outer ring | 513: Bearing |
| 514: Inner ring | 515: Tube | 516: Shaft |
| 520: Reference angle adjustment part | 521: Angle adjustment shaft | 522: Angle adjustment handle |
| 523: Shaft joint | 524: Angle adjustment end | 525: Ball bearing |
| 600: Pillar | 700: Foot plate | |

The invention claimed is:

1. A jumping exercise equipment comprising:

a fixed plate (100) consisting of a base of a jumping exercise equipment;

a stepping plate (200) that moves up and down on the fixed plate (100) and on which a user steps;

a stepping plate connecting movable member (300) having a first side rotatably connected to the fixed plate (100) and a second side rotatably connected to the stepping plate (200) and that keeps the stepping plate (200) horizontal;

an elastic portion (400) disposed on the fixed plate (100) and comprising a leaf spring (410) that imparts an elastic force to the stepping plate connecting movable member (300) in accordance with a change in the angle that the stepping plate connecting movable member (300) makes with the fixed plate (100); and a leaf spring pressing portion (500) coupled to the stepping plate connecting movable member (300) and acting as an action point in contact with a first end of the leaf spring (410), wherein the stepping plate (200) comprises: a fixed lever (210) to hold the stepping plate (200) from rotating; and a stepping plate elastic portion (220) disposed between the stepping plate (200) and the stepping plate connecting movable member (300) and having an elastic force, wherein the stepping plate elastic portion (220) comprises a coil spring made of a carbon steel material connected at one end to the stepping plate connecting movable member (300), and an elastic support member made of polymeric plastic material connected to an end of the coil spring and in contact with a portion of the stepping plate (200), wherein the elastic portion (400) further comprises: a leaf spring support member (420) provided at the lower end of the leaf spring (410) and movable in the longitudinal plane of the leaf spring (410); a spring loaded complementary member (430) provided on the leaf spring support member (420), which is in contact with a portion of the leaf spring (410) and serves as a reference point, and which adjusts the elastic force provided by the leaf spring (410) to the stepping plate connecting movable member (300), but includes an elastic member; and an elastic adjustment member (440) connected to the leaf spring support member (420) and adjusting the position of the leaf spring support member (420); a reference point locating confirmation member (450) associated with the leaf spring support member (420) and externally visible to confirm the position of the leaf spring support member (420); and a leaf spring lock (460), configured at the other end of the leaf spring (410) opposite the contacts with which the leaf spring pressing portion (500) is in contact and securing the leaf spring (410), wherein the spring loaded complementary member (430) comprises: a coil spring (431) of carbon steel connected at one end to the leaf spring support member (420); and an elastic support member (432) of polymeric plastic connected to an end of the coil spring (431), in communication with a portion of the leaf spring (410) and having a circular upper surface, wherein the leaf spring pressing portion (500) comprises: an actuating portion (510) which is contacted at one end of the leaf spring (410) and acts as an action point; and a reference angle adjustment portion (520) connecting the stepping plate connecting movable member (300) and the actuating portion (510), wherein the actuating portion (510) comprises: a housing (511) positioned at an outermost side and in contact with the leaf spring (410); an outer ring (512) being formed on an inner side of the housing (511); a bearing (513) formed on an inner side of the outer ring (512); an inner ring (514) formed on an inner side of the bearing (513); a tube (515) formed on an inner side of the inner ring (514); and an actuating shaft (516) formed on an inner side of the tube (515) as an axis of rotation, and wherein the reference angle adjustment portion (520) comprises: an angle adjustment shaft (521) which is an axis of rotation; an angle adjustment handle (522) for rotating the angle adjustment shaft (521); an axial engagement portion (523) for joining with a selected portion of the angle adjustment shaft (521); an angle adjustment end (524) in the form of a bolt for engaging a lower end of the angle adjustment shaft (521); and a ball bearing (525) for engaging a lower end of the angle adjustment end (524) wherein the angle adjustment shaft (521) is rotated by rotation of the angle adjustment handle (522), so that the angle of engagement between the stepping plate connection movable member (300) and the elastic part (400) is adjusted, wherein a shaft engagement portion (523) fixes the shake of an angle adjustment shaft (521).

* * * * *